US006612880B2

(12) United States Patent
Arnett et al.

(10) Patent No.: US 6,612,880 B2
(45) Date of Patent: Sep. 2, 2003

(54) COMMUNICATION CONNECTOR TERMINAL AND TERMINAL BLOCK CONFIGURATION

(75) Inventors: Jaime R. Arnett, Fishers, IN (US); Michael G. German, Secaucus, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 10/034,812

(22) Filed: Dec. 26, 2001

(65) Prior Publication Data

US 2002/0055304 A1 May 9, 2002

Related U.S. Application Data

(62) Division of application No. 09/524,654, filed on Mar. 13, 2000.

(51) Int. Cl.[7] ..... H01R 4/26; H01R 11/20

(52) U.S. Cl. ..... 439/825; 439/404

(58) Field of Search ..... 439/825, 404, 439/405, 79, 82, 692, 884

(56) References Cited

U.S. PATENT DOCUMENTS 3,223,960 A 12/1965 Ruehlemann
4,206,964 A 6/1980 Olsson
4,533,200 A 8/1985 Wilson
D354,268 S 1/1995 Siemon et al.
5,630,720 A 5/1997 Kocher
5,645,445 A 7/1997 Siemon
5,905,637 A * 5/1999 Su ..... 361/736
6,000,973 A 12/1999 Mitra
6,011,319 A * 1/2000 Kelly et al. ..... 307/10.1
6,093,048 A 7/2000 Arnett

* cited by examiner

*Primary Examiner*—Chandrika Prasad
(74) *Attorney, Agent, or Firm*—Woodbridge & Associates, P.C.; Richard C. Woodbridge, Esq.

(57) ABSTRACT

An electrical connector terminal includes a planar wire connecting portion formed to connect with an outside wire lead, the connecting portion defining a first plane. A shoulder portion of the terminal has a planar first section extending from a first side of the connecting portion, and the first section defines a second plane that is normal to the first plane of the connecting portion so that the terminal is held stable when mounted on a wiring board and the first section of the shoulder portion is restrained by an outside part located out of the first plane of the wire connecting portion. An elongated mounting portion or tail is formed to fit axially in a terminal opening in the wiring board. The tail is joined to a free end of the first section of the shoulder portion remote from the wire connecting portion, and the second plane of the first section includes the axis of the mounting portion.

22 Claims, 12 Drawing Sheets

COMMUNICATION CONNECTOR TERMINAL AND TERMINAL BLOCK CONFIGURATION

CROSS REFERENCE TO RELATED APPLICATION

This application is a divisional of co-pending U.S. application Ser. No. 09/524,654 filed Mar. 13, 2000, and entitled "Communication Connector Terminal Configuration Including Cross-talk Compensation Coupling."

BACKGROUND OF THE INVENTION

1. Field of the Invention

This invention relates to connector terminals and terminal blocks for communication wires or cables.

2. Discussion of the Known Art

A terminal post having a retaining portion with an axially directed slot and configured for mounting in a terminal opening in a printed wiring board, is disclosed in U.S. Pat. Des. 354,268 (Jan. 10, 1995), and in U.S. Pat. No. 5,645,445 (Jul. 8, 1997). Also, U.S. Pat. No. 4,206,964 (Jun. 10, 1980) shows a terminal with a retaining portion in the form of two arcuate spring members separated by an opening to resemble a needle eye.

U.S. Pat. No. 5,630,720 (May 20, 1997) shows a signal contact terminal formed from a flat strip of metal such as phosphor bronze, the terminal having a contact leg or retaining portion adapted for insertion in a through hole in a circuit board. Portions of the contact leg at either side of the leg axis, are swaged in opposite directions perpendicular to the plane of the metal strip. U.S. Pat. No. 3,223,960 (Dec. 14, 1965) and U.S. Pat. No. 4,533,200 (Aug. 6, 1985) also show terminals with retaining or "tail" portions having other configurations.

U.S. Pat. No. 6,000,973 issued Dec. 14, 1999, relates to an electrical connector with plug contact elements. FIGS. 6A–6C of the '973 patent show IDC terminal ends of various configurations, which may be formed with plug contacts that are shown in FIGS. 1–3 of the '973 patent.

U.S. Pat. No. 6,093,048 issued Jul. 25, 2000, and assigned to the assignee of the present application and invention, discloses a solderless, mountable insulation displacement connector (IDC) terminal wherein a wiring board mounting part of the terminal has a needle eye configuration for retaining the terminal by friction in a terminal opening in a printed wiring board.

An electrical connector terminal that can withstand stresses and remain stable once the terminal is mounted on a wiring board and wire leads are connected to and disconnected from the terminal, is very desirable. Further, a connector terminal arrangement wherein a desired amount of capacitive or inductive coupling can be established between a given pair of terminals when mounted on a wiring board is very useful for implementing, e.g., crosstalk compensation or reduction.

SUMMARY OF THE INVENTION

According to the invention, an electrical connector terminal includes an elongated, generally planar wire connecting portion formed to connect with an outside wire lead, the connecting portion defining a first plane. A shoulder portion of the terminal has a planar first section extending from a first side of the connecting portion, wherein the first section defines a second plane normal to the first plane of the connecting portion so that the terminal will be held stable when the terminal is mounted on a wiring board and the first section is restrained by an outside part located outside of the first plane of the wire connecting portion. An elongated mounting portion of the terminal has an axis and is formed to fit axially in a terminal opening in the wiring board. The mounting portion is joined to a free end of the first section of the shoulder portion remote from the wire connecting portion, and the second plane of the first section includes the axis of the mounting portion.

According to another aspect of the invention, an electrical connector terminal block includes a housing, a wiring board supported in the housing, and a base wall supported in the housing in the vicinity of the wiring board. A first connector terminal and a second connector terminal are mounted on the wiring board, wherein each terminal includes an elongated, generally planar wire connecting portion formed to connect with an outside wire lead, the connecting portion defining a first plane. A shoulder portion of the terminal has a planar first section extending from a first side of the connecting portion, wherein the first section defines a second plane normal to the first plane of the connecting portion and the first section of the shoulder portion is restrained by the base wall at a position out of the first plane of the wire connecting portion so that the terminal is held stable relative to the wiring board. An elongated mounting portion of the terminal has an axis and is formed to fit axially in a terminal opening in the wiring board. The mounting portion is joined to a free end of the first section of the shoulder portion remote from the wire connecting portion, and the second plane of the first section includes the axis of the mounting portion.

For a better understanding of the invention, reference is made to the following description taken in conjunction with the accompanying drawing and the appended claims.

DETAILED DESCRIPTION OF THE INVENTION

Figure 1:
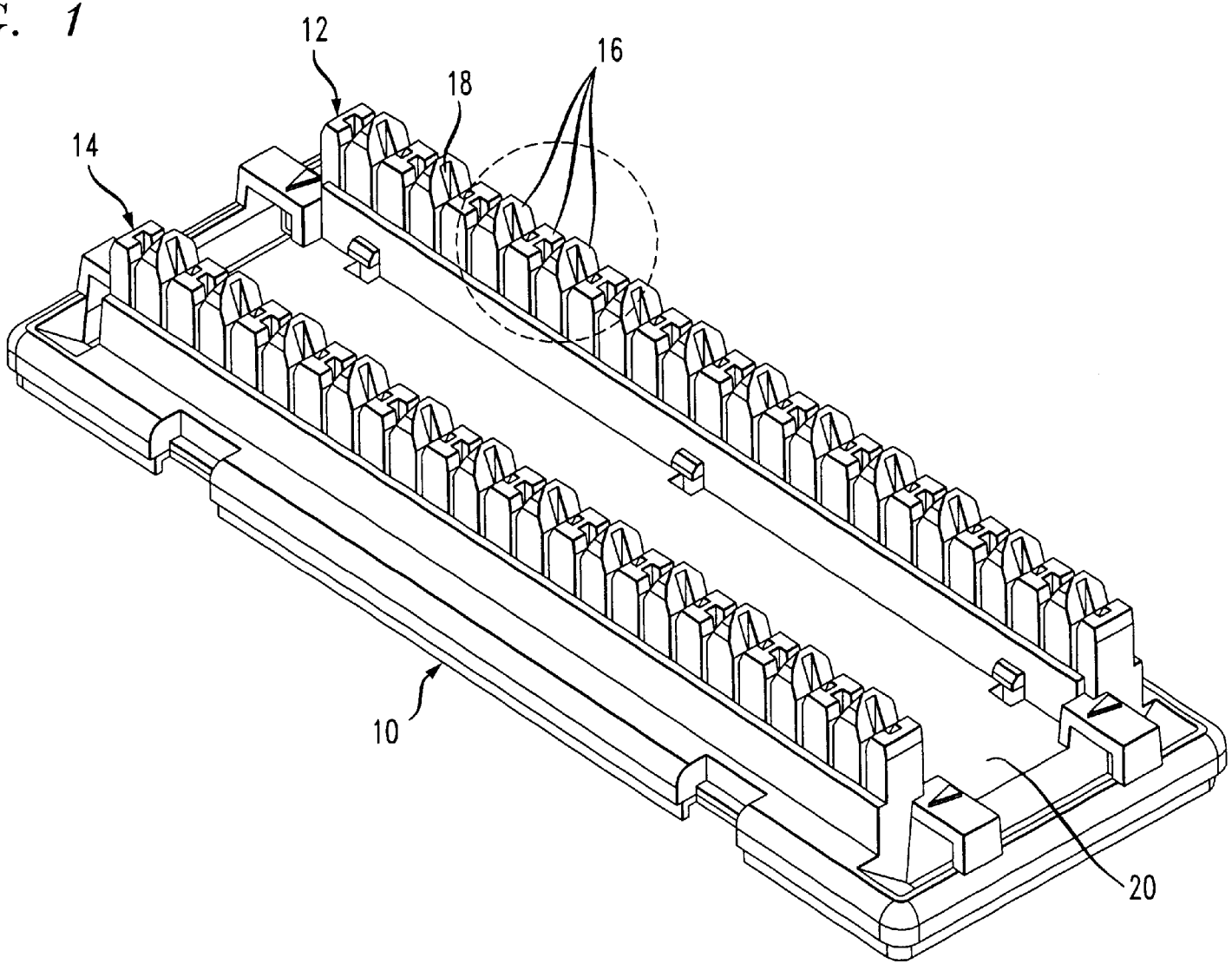
FIG. 1 is a perspective view of an electrical connector terminal housing or block in which connector terminals of the present invention may be used.

FIG. 1 shows an electrical connector terminal housing 10, in which electrical connector terminals of the invention may be assembled. For purposes of illustration and without limitation, the housing 10 surrounds two rows 12, 14 of connector terminals, wherein the terminals are accessible between a number of terminal wire guide posts 16. In the disclosed embodiments, the connector terminals are insulation displacement connector (IDC) terminals. Each IDC terminal has an axially directed vertical slot for receiving one or more outside wire leads, and for cutting through insulation about the leads to establish electrical contact as the leads are urged downward between a pair of the posts 16 and into the terminal slot. Pairs of the posts 16 together define vertical channels 18 within which associated IDC terminals are received and captured. The posts are spaced apart enough to allow outside wire leads to be urged downward between them and into a terminal slot.

The terminal housing 10 contains a printed wiring board (not shown in FIG. 1) that is supported within the housing. The electrical connector terminals are mounted on the wiring board and are restrained from movement by parts of the terminal housing 10, including, e.g., a base wall 20 of the housing as explained below.

Figure 2:
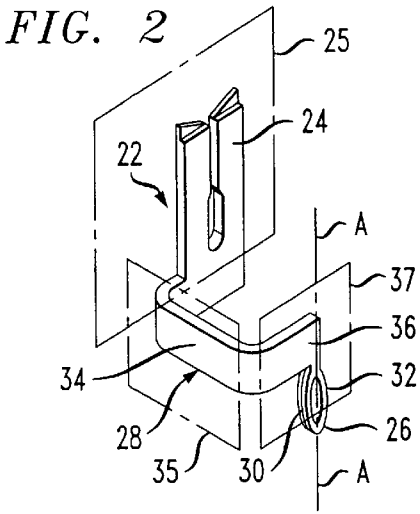
FIG. 2 is a perspective view of a first embodiment of an electrical connector terminal of the invention.

FIG. 2 is a view of a first embodiment of an electrical connector terminal of the invention. In FIG. 2, an electrical connector terminal 22 is formed, e.g., from a sheet of phosphor bronze or beryllium copper, typically about 0.016 inch thick. The terminal 22 has a wire connecting portion 24 which, in the illustrated embodiments, has an insulation displacement connector (IDC) configuration and lies within a plane 25. The wire connecting portion 24 is typically about 0.085 inches wide at the top, and about 0.200 inches overall height.

Terminal 22 also has an elongated, wiring board mounting portion 26 having an axis A. In the disclosed embodiments the wiring board mounting portion 26 is formed to be press fit axially into a terminal opening in a printed wiring board (not shown in FIG. 2). The mounting portion 26 has two opposed curvilinear sections 30, 32 forming an elongated, open needle-eye configuration about the axis A of the mounting portion. The height of the mounting portion 26 is typically about 0.093 inches, and the width of the mounting portion is typically about 0.036 inches.

A shoulder portion 28 extending from one side of the terminal 22 is formed and dimensioned to project in a direction normal to the plane 25 of the wire connecting portion 24, and to join the wire connecting portion 24 and the mounting portion 26 to one another. In FIG. 2, the shoulder portion 28 is generally C-shaped, as viewed from above, and has sections 34, 36, that extend in planes 35, 37 that are substantially parallel to the axis A of the mounting portion 26. Because part of the shoulder portion 28 (section 34) projects normally of the plane 25 of the wire connecting portion 24, the terminal 22 can be held stably on a wiring board on which the terminal 22 is mounted by allowing the shoulder portion including both sections 34, 36 to be restrained by parts of the terminal housing 10, at positions outside the plane 25 of the wire connecting portion 24. See FIG. 8.

In the illustrated embodiment, the shoulder portion 28 projects about 0.150 inches from the wire connecting portion 24. As mentioned, both of the sections 34, 36 of the shoulder portion 28 extend in planes 35, 37 that are substantially parallel to the axis A of the mounting portion 28. Also, while the plane 35 of section 34 is generally perpendicular to the plane 25 of the wire connecting portion 24, the plane 37 of the shoulder portion section 36 is generally parallel to the plane 25 of the connecting portion 24, and the mounting portion 26 is joined to a free end of the shoulder portion section 36.

Figure 3:
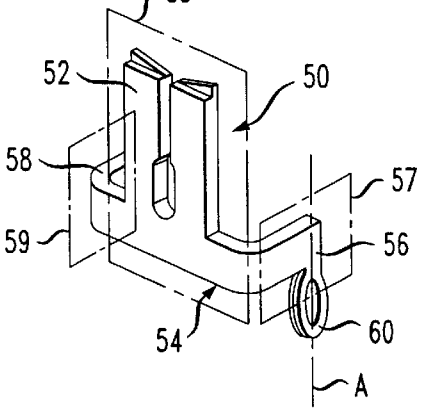
FIG. 3 is a perspective view of a second embodiment of an electrical connector terminal of the invention.

FIG. 3 is a perspective view of a second embodiment of an electrical connector terminal 50, according to the invention. Terminal 50 has a wire-connecting portion 52 which may be formed the same as or similar to the connecting portion 24 in FIG. 2, and which lies within a plane 53. The terminal 50 also has a generally "C"-shaped shoulder portion 54 as viewed from above, with sections 56, 58 that lie in planes 57, 59 that are normal to the plane 53 of the wire connecting portion 52 at either side of the connecting portion. Terminal 50 also has a wiring board mounting portion 60, which may be formed the same as or similar to the mounting portion 26 of terminal 22 in FIG. 2. In FIG. 3, shoulder section 56 is joined at its free end to the mounting portion 60. The planes 57, 59 of the shoulder sections 56, 58, also extend parallel to the axis A of the wiring board mounting portion 60, and sections 56, 58 project in the same direction a distance of about 0.100 inches normal to the plane 53 of the wire connecting portion 52.

Figure 4:
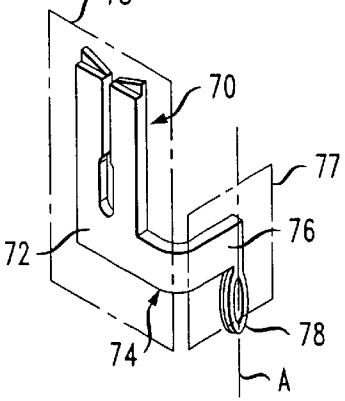
FIG. 4 is a perspective view of a third embodiment of an electrical connector terminal of the invention.

FIG. 4 shows a third embodiment of an electrical connector terminal 70 of the invention. Terminal 70 has a wire connecting portion 72 that lies within a plane 73. A shoulder portion 74 of the terminal forms a single arm 76 that projects from one side of the terminal normal to the plane 73 of the wire connecting portion 72. Arm 76 is joined at its free end to a wiring board mounting portion 78. The shoulder arm 76 lies in a plane 77 that coincides with the axis A of the mounting portion 78, and the arm 76 is positioned about, e.g., 0.050 inches to the side of connecting portion 72.

Figure 5:
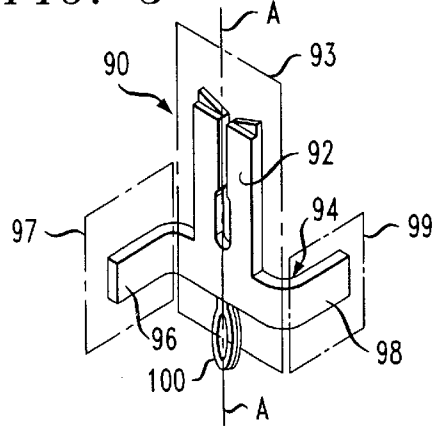
FIG. 5 is a perspective view of a fourth embodiment of an electrical connector terminal of the invention.

FIG. 5 is a view of a fourth embodiment of an electrical connector terminal 90 according to the invention. Terminal 90 has a wire connecting portion 92 that lies in a plane 93, and a shoulder portion 94 having sections 96, 98 that project from either side and in opposite directions from the wire connecting portion 92. The shoulder portion sections 96, 98 lie in planes 97, 99 which are normal to the plane 93 of the connecting portion 92. A wiring board mounting portion 100 is joined at a bottom edge of the shoulder portion 94, and the axis A of mounting portion 100 is the same as that of the connecting portion 92 of the terminal. Each of the planes 97, 99 of the shoulder sections 96, 98 are also parallel to the axis A of the mounting portion 100. Each section 96, 98 stands about, e.g., 0.060 inches high, and projects, e.g., about 0.080 inches from wire connecting portion 92.

Figure 6:
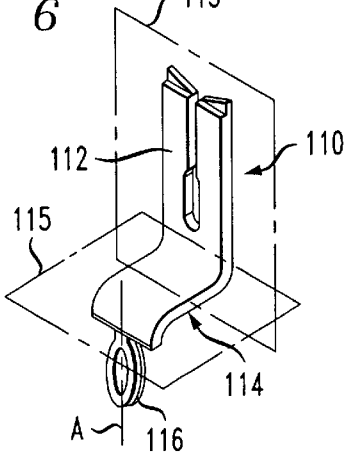
FIG. 6 is a perspective view of a fifth embodiment of an electrical connector terminal of the invention.

FIG. 6 is a view of a fifth embodiment of an electrical connector terminal 110 according to the invention. Terminal 110 has a wire connecting portion 112 that lies in a plane 113, and a shoulder portion 114 that projects normal to the plane 113 of the connecting portion. The shoulder portion 114 also lies in a plane 115 that is generally perpendicular to the axis A of a wiring board mounting portion 116, the latter being joined to a free end of the shoulder portion 114 opposite the wire connecting portion 112. Ninety degree bends in the terminal 110 at either end of the shoulder portion 114 have a typical radius of, e.g., about 0.030 inches.

Figure 7:
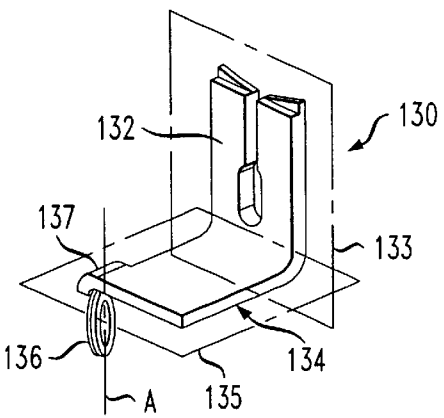
FIG. 7 is a perspective view of a sixth embodiment of an electrical connector terminal of the invention.

FIG. 7 is a view of a sixth embodiment of an electrical connector terminal 130 according to the invention. Terminal 130 has a wire connecting portion 132 that lies in a plane 133, and a shoulder portion 134 that projects normally of the plane 133 of the connecting portion 132 by a distance of, e.g., 0.100 inches. The shoulder portion 134 lies in a plane 135 that is generally perpendicular to the axis A of a wiring board mounting portion 136, the latter being joined via a 90 degree bend 137 to a side corner of the shoulder portion 134 opposite the wire connecting portion 132. The width of the bend 137 may be about, e.g., 0.050 inches.

Figure 8:
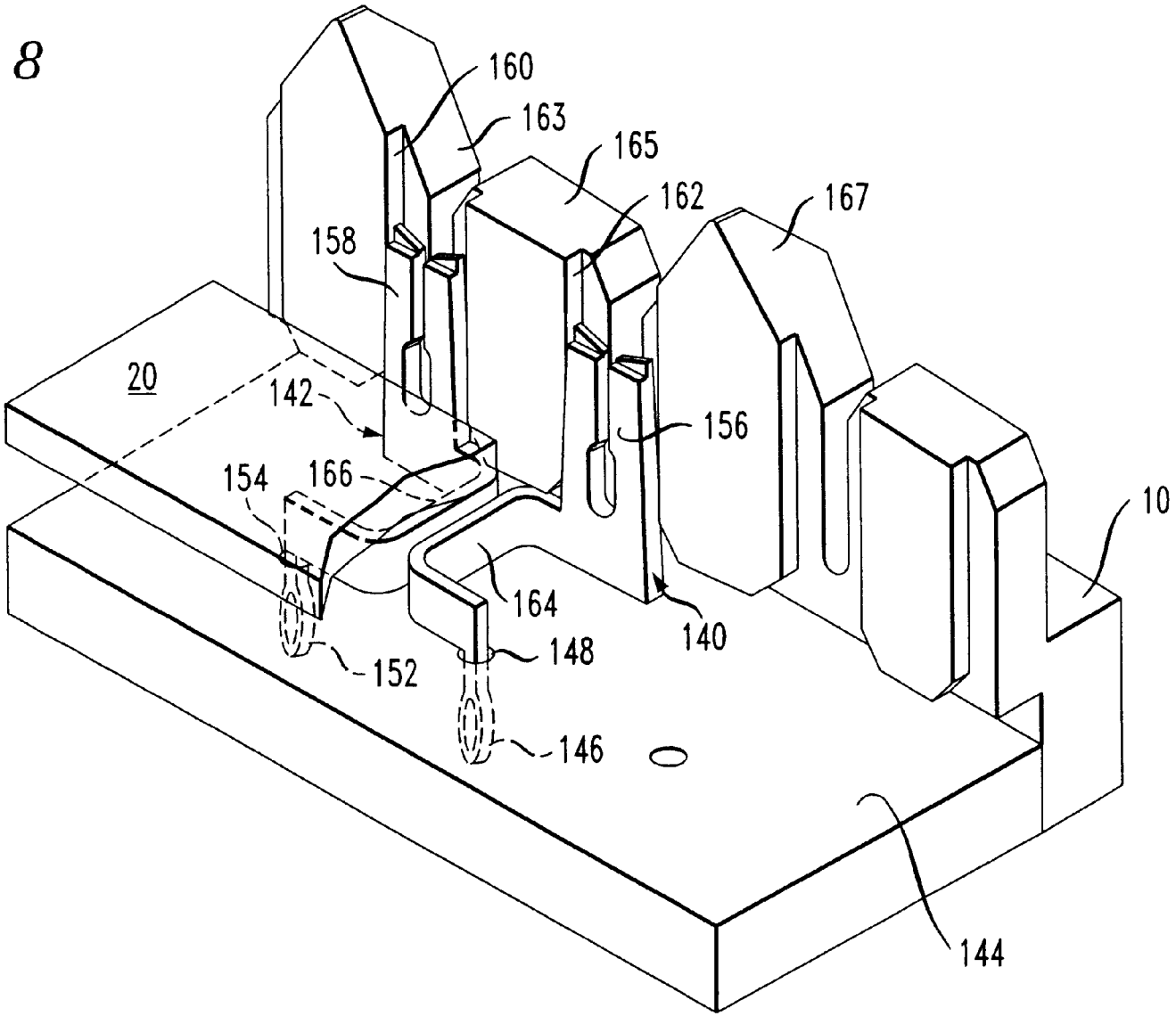
FIG. 8 is a perspective view of electrical connector terminals of the first embodiment of FIG. 2, mounted on a printed wiring board within a terminal housing.

FIG. 8 is a view of an inside portion of the terminal housing 10 in FIG. 1, in which connector terminals 140, 142 corresponding to the first embodiment of FIG. 2 are mounted on a wiring board 144. The wiring board 144 is supported within the housing 10, and the base wall 20 of the housing is supported above and parallel to the wire board.

A mounting portion 146 of terminal 140 is received in a terminal opening 148 in wiring board 144. Portions of the wall of opening 148 are plated to establish electrical contact between the terminal 140 and other conductors on or within the wiring board 144. Terminal 142 also has a mounting portion 152 which is received in a terminal opening 154 in the board 144.

When assembled as shown, planar wire connecting portions 156, 158 of the terminals 140, 142, are captured within corresponding channels 162, 160 formed by adjacent terminal wire guide posts 167, 165, and 163, respectively. Terminals 140, 142, also have confronting shoulder portions 164, 166, whose bottom edges are substantially flush with the wiring board 144, and whose top edges are restrained from upward movement by the base wall 20 of the terminal housing.

FIG. 8 shows that the present terminal construction affords stability to the terminals 140, 142 when mounted on the wiring board 144. Wear or fracture at the necks of the mounting portions 146, 152 that could result from applied forces or bending moments about the mounting portions, are avoided by restraining the projecting shoulder portions 164, 166 between the wiring board 144 and the base wall 20 of the terminal housing, outside of the plane of the wire connecting portions 156, 158.

Due to the proximity of shoulder portions 164, 166 to one another, it will be appreciated that a degree of capacitive coupling, e.g., on the order of 1.0 picofarads, may be introduced between the terminals 140, 142, particularly where the shoulder portions are closely spaced parallel to one another using known plate capacitor formulas. In addition, due to the extended lengths of the shoulder portions, 164, 166 and their proximity to one another, mutual inductive coupling may be introduced between the shoulder portions of adjacent terminals 140, 142. Such coupling, which may typically be in the order of about 0.3 nanohenries, can operate toward reducing or compensating for crosstalk among signal paths carried by terminals 140, 142, and other terminals on the wiring board 144. Capacitive or inductive coupling between shoulder portions of terminals mounted on the wiring board 144, may also obviate the need for configurations of wire traces on several layers of the board, and would allow the board to have only one layer with associated cost reductions.

A desired amount of mutual inductance may be produced at the shoulder portions of two terminals using known parallel plate conductor formulas. See, e.g., F. W. Grover, Inductance Calculations; Working Formulas and Tables, at page 34, where the mutual inductance M between two parallel plates of equal height, length and thickness, is given by $$M=0.002(l)[log_e(2l/d)-log_e k-1+d/l-d^2/4l^2]$$

where: l=length of each plate d=plate spacing $log_e$ is a tabulated term describing geometric mean distance Using the above formula, for a plate thickness of 0.016", height of 0.100", length of 0.200" and spacing of 0.084", M=0.3 nanohenries.

Figure 9:
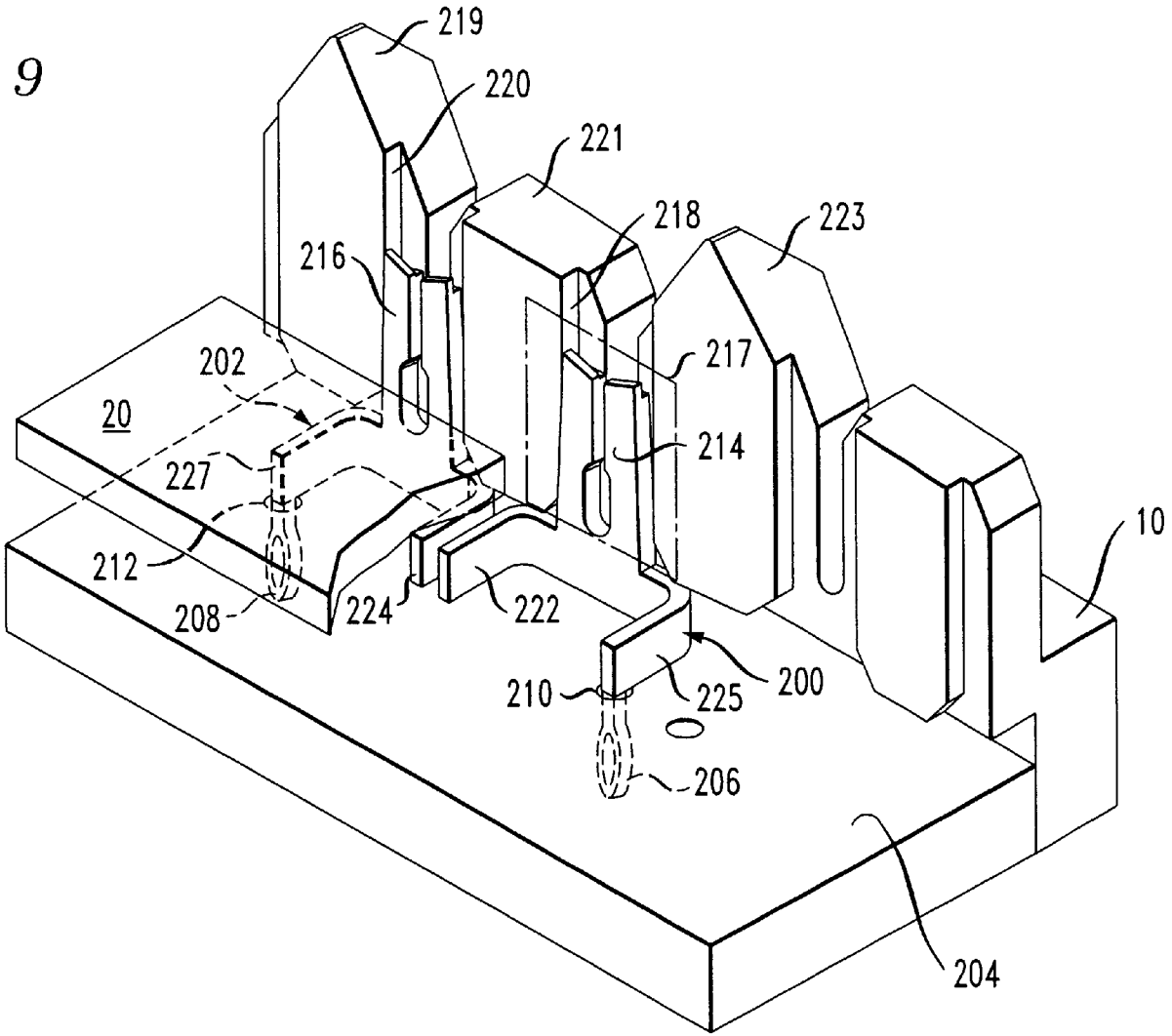
FIG. 9 is a perspective view of electrical connector terminals of the second embodiment of FIG. 3, mounted on a wiring board within a terminal housing.

FIG. 9 is a view of a portion of the terminal housing 10, with connector terminals 200, 202 mounted on a wiring board 204 which is supported within the terminal housing 10. The terminals 200, 202 correspond to the second connector terminal embodiment of FIG. 3. Mounting portions 206, 208 of the terminals are received in corresponding terminal openings 210, 212 in the wiring board 204. The terminals each have wire connecting portions 214, 216 that lie in a plane 217. The wire connecting portions 214, 216 are captured within corresponding channels 218, 220 formed by terminal wire guide posts 223, 221, 219, respectively. Shoulder portions of the terminals 200, 202 have corresponding planar sections 222, 224 that are positioned on the board 204 parallel and adjacent to one another, so that some degree of capacitive coupling may also be established between the adjacent sections 222, 224 of the terminals 200, 202 for purposes of crosstalk compensation or reduction. Bottom edges of the shoulder portions of the terminals are aligned substantially flush with the wiring board 204, and top edges of the shoulder portions are restrained from upward movement by the base wall 20 of the terminal housing 10. If the terminal mounting portions 206, 208 are joined to non-adjacent sections 225, 227 of the corresponding shoulder portions, as shown in FIG. 9, signal currents will be directed through the non-adjacent sections 225, 227 so that substantially no inductive coupling will be produced between parts of the adjacent terminals 200, 202.

Figure 10:
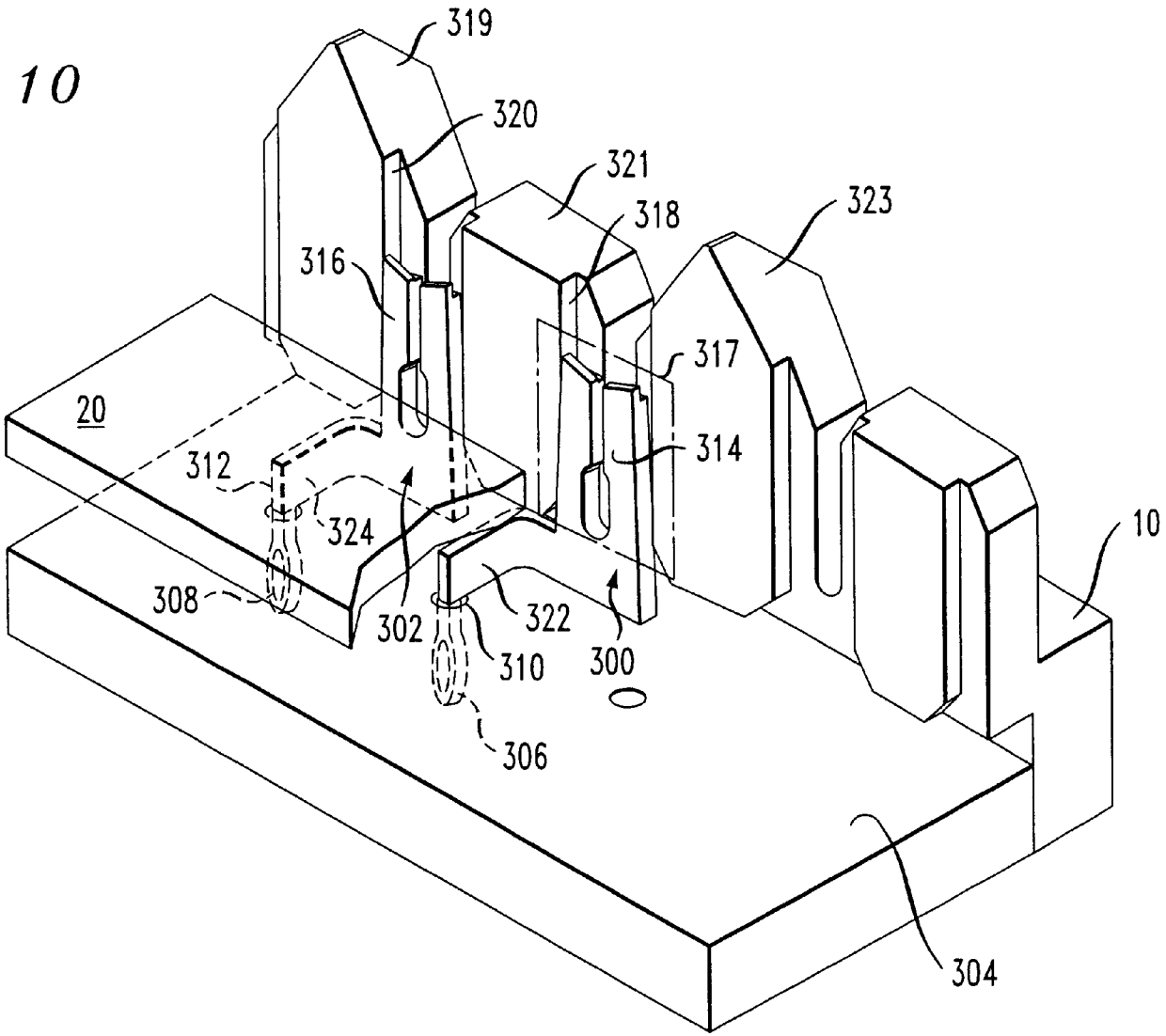
FIG. 10 is a perspective view of electrical connector terminals of the third embodiment of FIG. 4, mounted on a wiring board within a terminal housing.

FIG. 10 shows connector terminals 300, 302 mounted on a wiring board 304 that is supported within a portion of the terminal housing 10. The terminals 300, 302 correspond to those of the third embodiment of FIG. 4. Mounting portions 306, 308 of the terminals are received in corresponding terminal openings 310, 312 in the wiring board 304. Wire connecting portions 314, 316 of the terminals lie in a plane 317. The wire connecting portions 314, 316 are captured within corresponding channels 318, 320 formed by terminal wire guide posts 323, 321, 319, respectively. As shown in FIG. 10, shoulder portions of the terminals 300, 302 have corresponding planar sections 322, 324 that are located relatively far apart on the board 304, so that the sections 322, 324 contribute substantially insignificant, if any, capacitive coupling between the terminals 300, 302. Bottom edges of the shoulder portions of the terminals are aligned flush with the wire board 304, and top edges of the shoulder portions are restrained from upward movement by the base wall 20 of the terminal housing 10.

Figure 11:
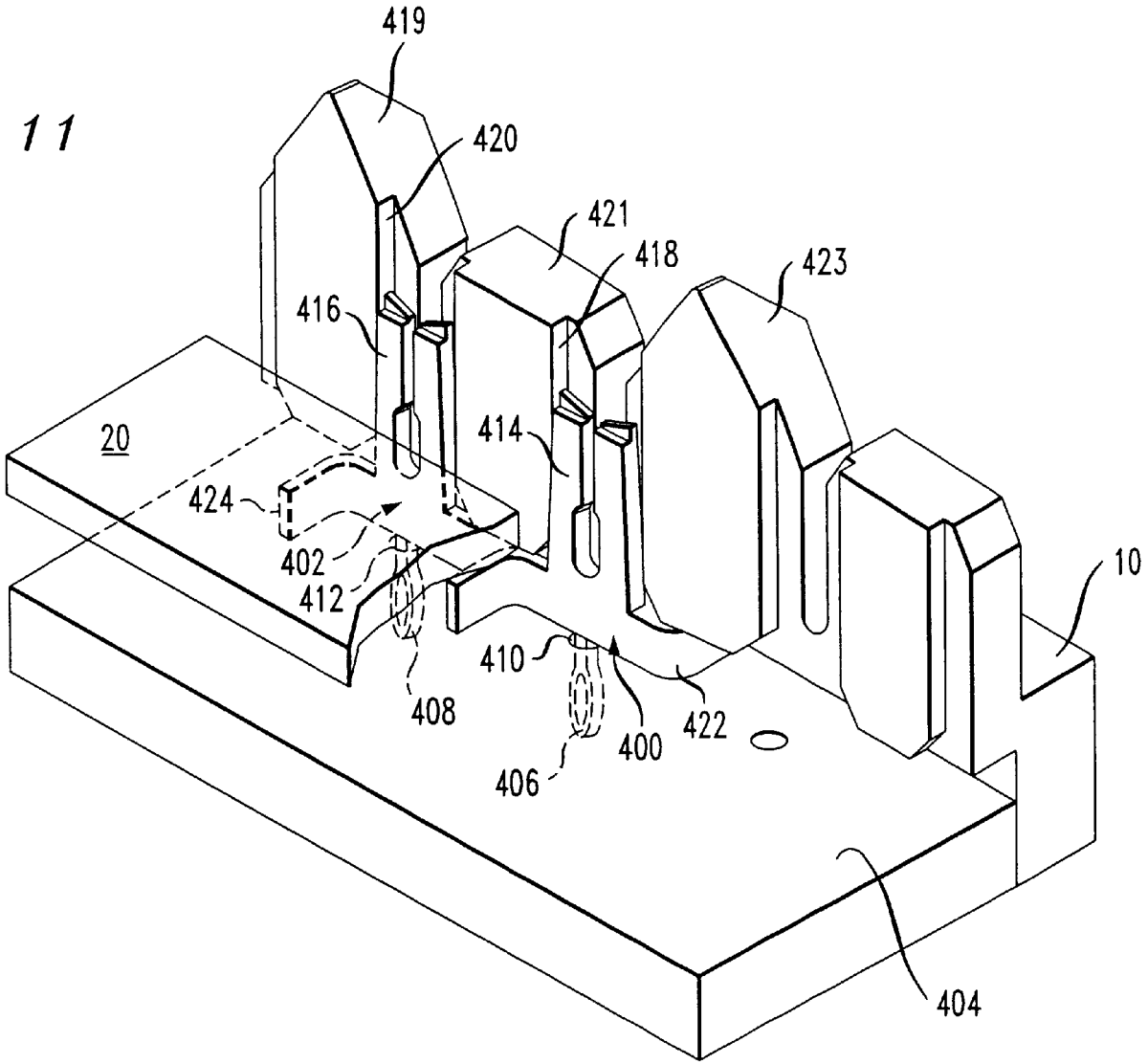
FIG. 11 is a perspective view of electrical connector terminals of the fourth embodiment of FIG. 5, mounted on a wiring board within a terminal housing.

FIG. 11 shows connector terminals 400, 402 of the fourth embodiment (FIG. 5) mounted on a wiring board 404 that is supported within a portion of the terminal housing 10. Mounting portions 406, 408 of the terminals are received in corresponding terminal openings 410, 412 in the board 404. Planar wire connecting portions 414, 416 are captured within corresponding channels 418, 420 formed by terminal wire guide posts 423, 421, 419. Shoulder portions 422, 424 of the terminals project normally and in opposite directions from the plane of the wire connecting portions 414, 416. Arms of the shoulder portions that extend inwardly of the housing 10 are restrained from upward movement by the housing base wall 20. The remaining arms extend beneath and are restrained by bottom surfaces of the wire guide posts over the wiring board 404.

Figure 12:
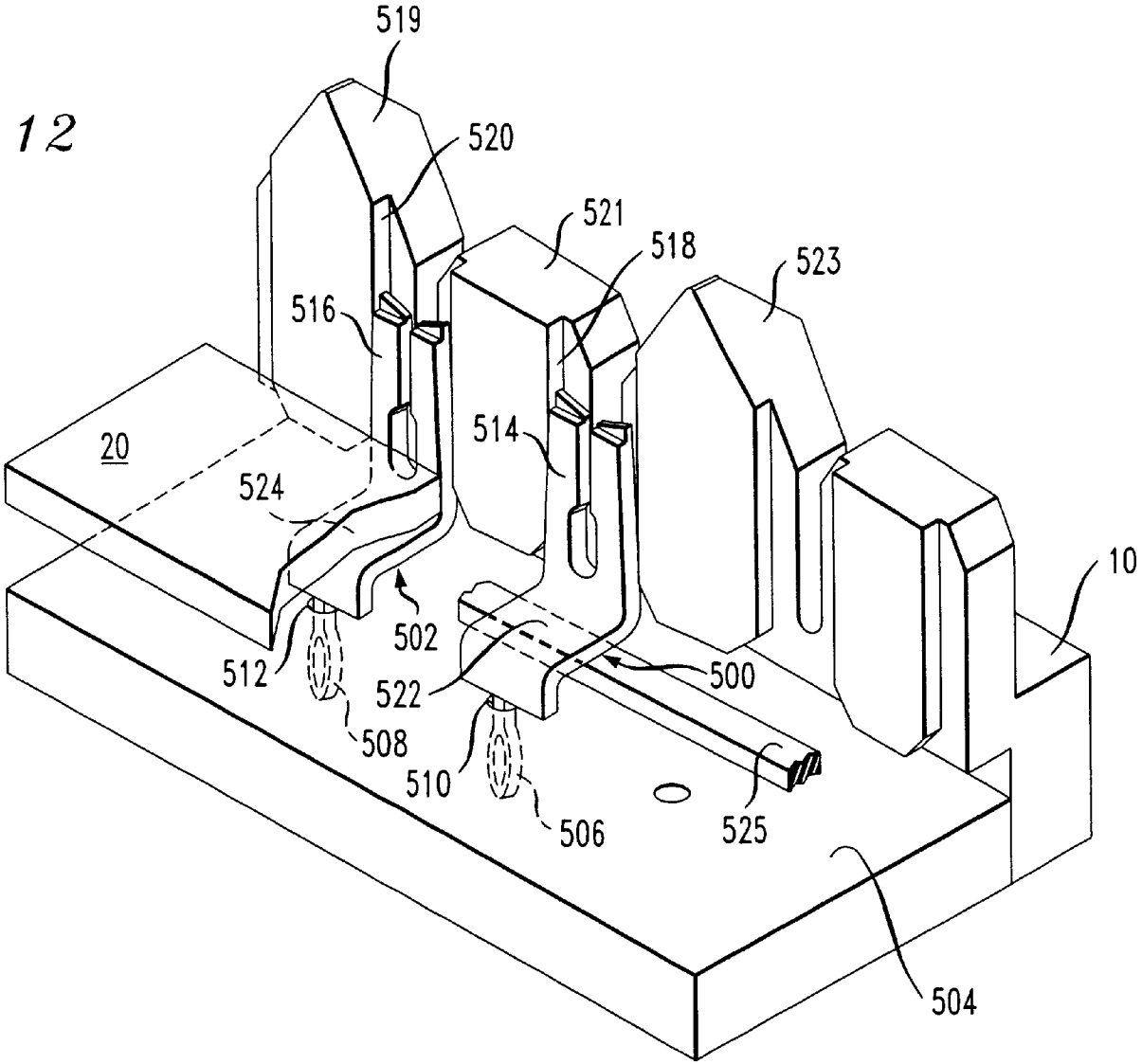
FIG. 12 is a perspective view of electrical connector terminals of the fifth embodiment of FIG. 6, mounted on a wiring board within a terminal housing.

FIG. 12 is a view of electrical connector terminals 500, 502 of the fifth embodiment (FIG. 6) mounted on a wiring board 504 that is assembled within a portion of the terminal housing 10. Mounting portions 506, 508 of the terminals are received in corresponding terminal openings 510, 512 in the wiring board 504. Planar wire connecting portions 514, 516 are captured in corresponding channels 518, 520 formed by terminal wire guide posts 523, 521, 519. Shoulder portions 522, 524 of the terminals project in a plane that is perpendicular to the axes of the mounting portions, and are restrained from upward movement by the housing base wall 20. An insulative strip or step 525 may be disposed on the wiring board directly beneath and in contact with the terminal shoulder portions to restrain downward movement of the shoulder portions and their associated terminals.

Figure 13:
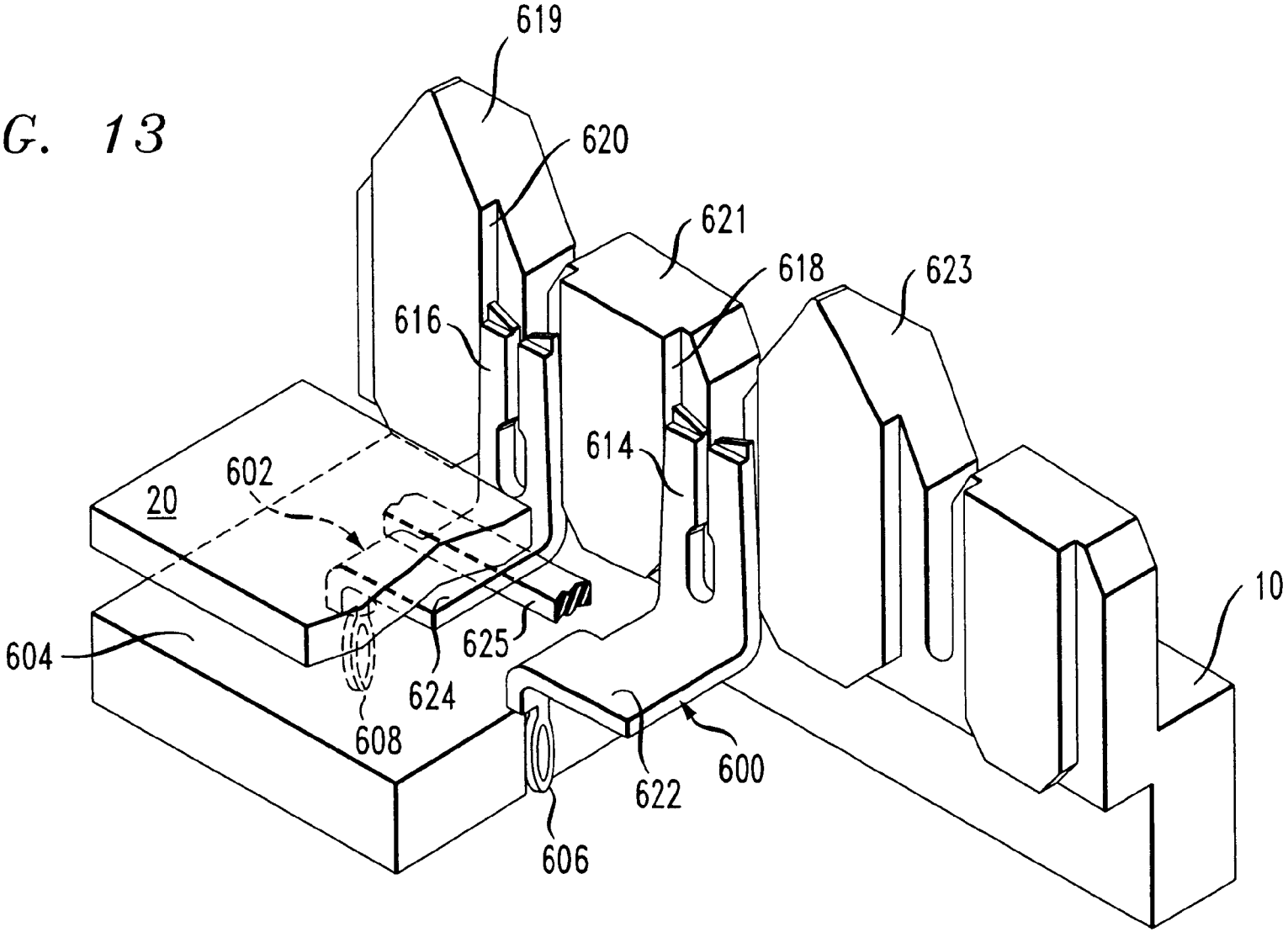
FIG. 13 is a perspective view of electrical connector terminals of the sixth embodiment of FIG. 7, mounted on a wiring board within a terminal housing.

FIG. 13 is a view of connector terminals 600, 602 according to the sixth embodiment (FIG. 7) mounted on a wiring board 604 that is supported within a portion of the terminal housing 10. Mounting portions 606, 608 of the terminals are received in corresponding terminal openings in the board 604. Wire connecting portions 614, 616 of the terminals are captured within corresponding channels 618, 620 formed by terminal wire guide posts 623, 621, 619. Shoulder portions 622, 624 of terminals 600, 602 project in a plane perpendicular to the axes of the mounting portions, and are restrained from upward movement by the base wall 20 of the terminal housing 10. An insulative strip or step 625 may be disposed on the wiring board directly beneath and in contact with the terminal shoulder portions to restrain downward movement of the shoulder portions and their associated terminals.

Figure 14:
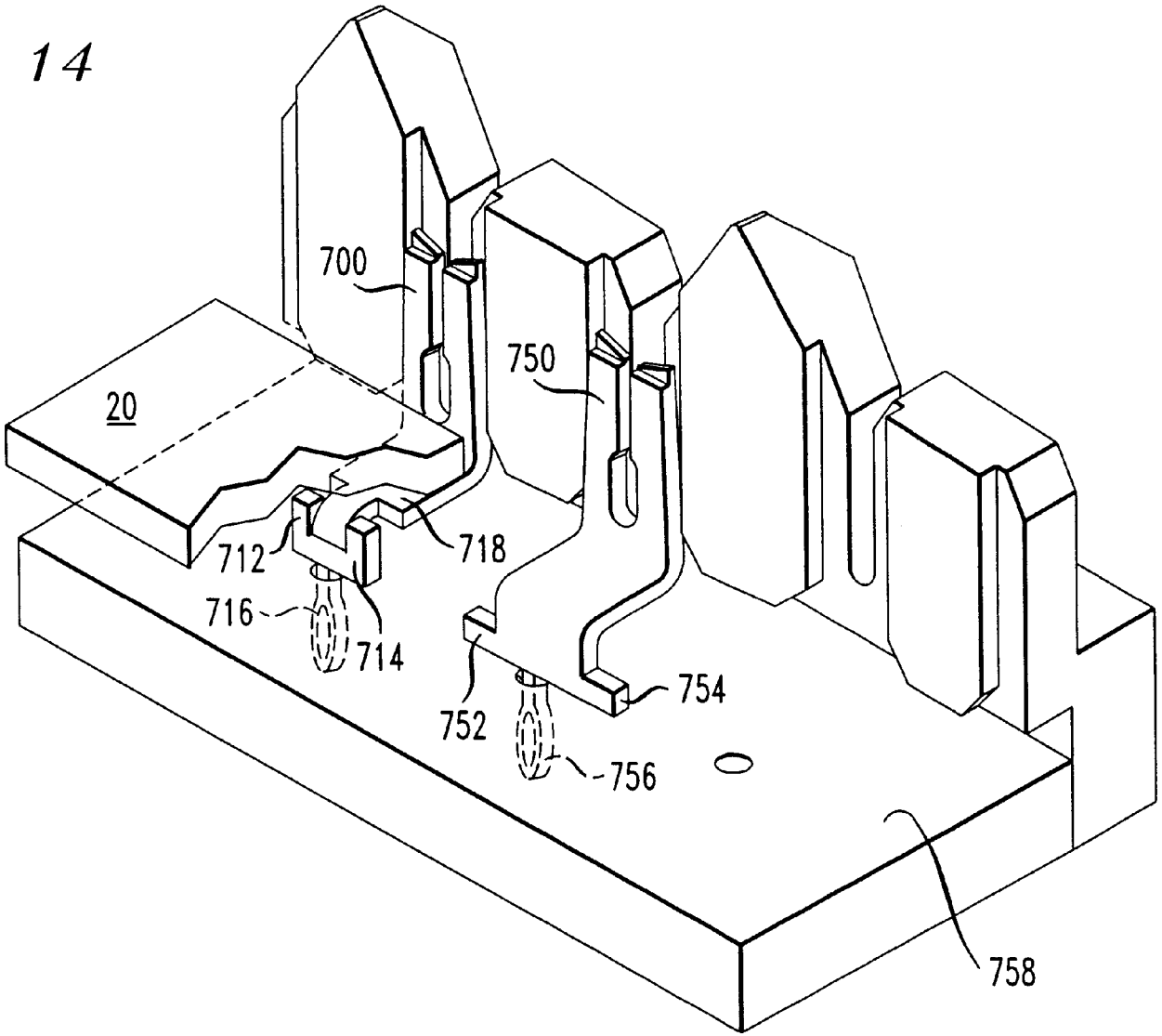
FIG. 14 is a perspective view of a modified connector terminal of FIG. 6, mounted on a wiring board within a terminal housing.

FIG. 14 shows two modifications of the terminal embodiment of FIGS. 6 and 12. To obtain a larger degree of restraint by the base wall 20 of the terminal housing, terminal 700 at the left in FIG. 14 is formed to have two fingers 712, 714 that project upward from either side of the neck of the mounting portion 716. Top surfaces of the fingers 712, 714, are dimensioned to be co-planar with shoulder portion 718 of the terminal, so that both fingers 712, 714 together with the shoulder portion 718 will be disposed substantially flush with a bottom surface of the base wall 20.

Terminal 750 at the right in FIG. 14 is formed to have two fingers 752, 754 that project in-line from either side of the neck of the mounting portion 756. Bottom surfaces of the fingers 752, 754 are dimensioned to be substantially flush with the top surface of a wiring board 758 on which the terminal 750 is mounted. Thus, a larger degree of restraint of the terminal 750 is provided by the wiring board 758, with respect to that obtained in the embodiments of FIGS. 6 and 12.

Figure 15:
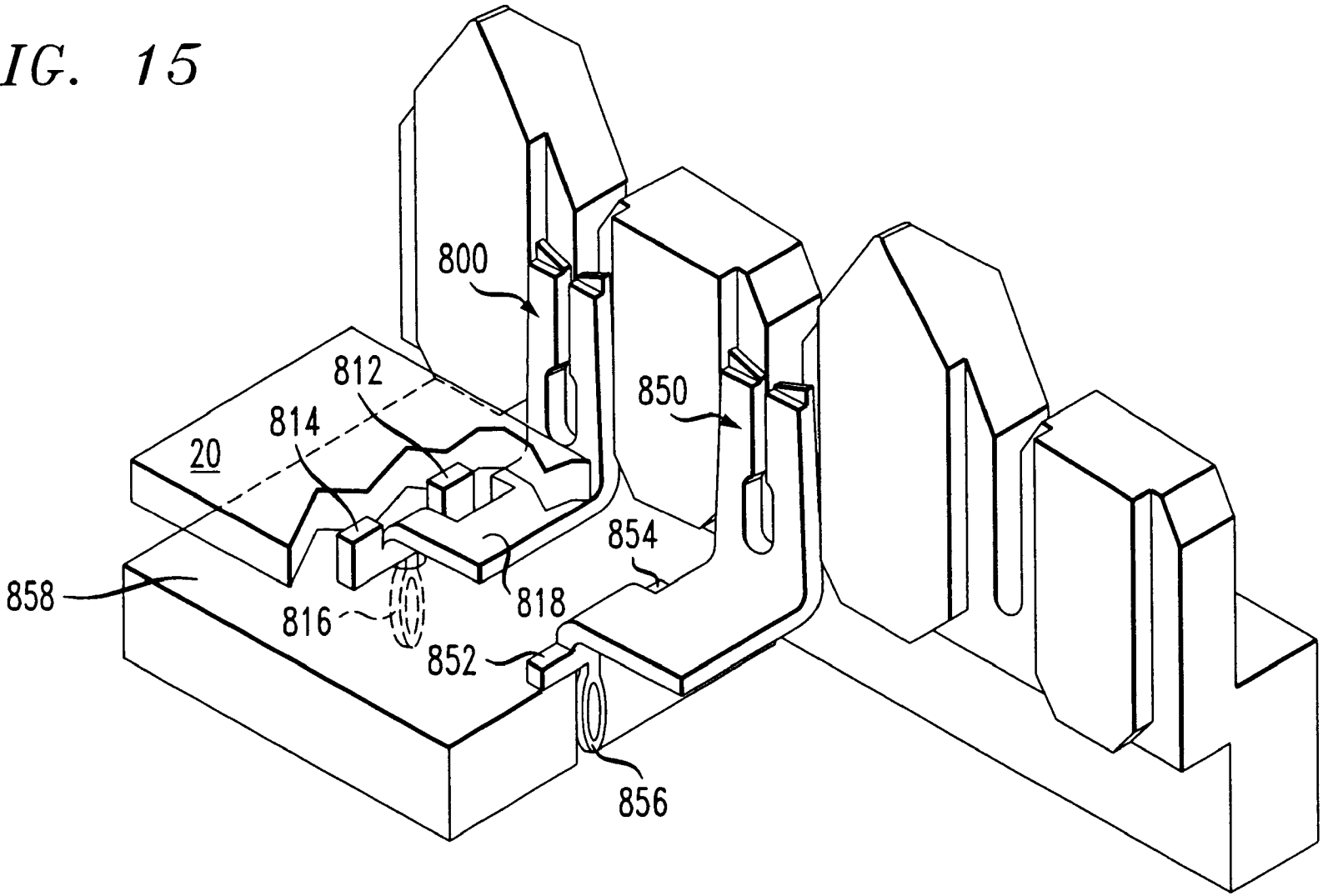
FIG. 15 is a perspective view of a modified connector terminal of FIG. 7, mounted on a wiring board within a terminal housing.

FIG. 15 shows two modifications of the terminal embodiment of FIGS. 7 and 13. To obtain a larger degree of restraint by the base wall 20 of the terminal housing, terminal 800 at the left in FIG. 14 is formed to have two fingers 812, 814 that project upward from either side of the neck of the mounting portion 816. Top surfaces of the fingers 812, 814 are dimensioned to be co-planar with shoulder portion 818 of the terminal, so that both fingers 812, 814 together with the shoulder portion 818 will be disposed substantially flush with a bottom surface of the base wall 20.

Terminal 850 at the right in FIG. 15 is formed to have two fingers 852, 854 that project in-line from either side of the neck of the mounting portion 856. Bottom surfaces of the fingers 852, 854 are dimensioned to be substantially flush with the top surface of a wiring board 858 on which the terminal 850 is mounted. Thus, a larger degree of restraint of the terminal 850 is provided by the wiring board 858, with respect to that obtained in the embodiments of FIGS. 7 and 13.

Figure 16:
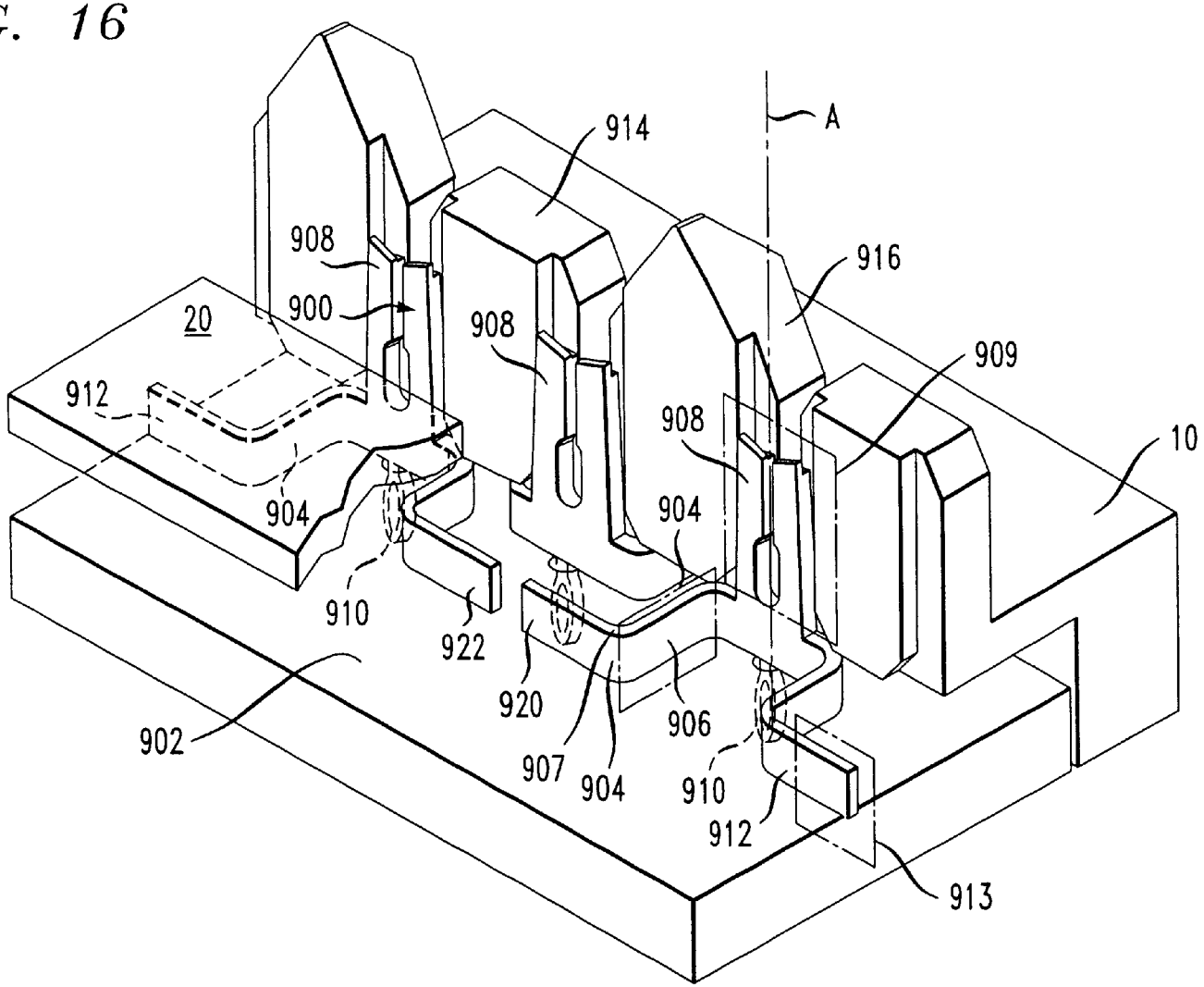
FIG. 16 is a perspective view of a seventh embodiment of an electrical connector terminal mounted on a wiring board within a terminal housing.

FIG. 16 is a view of a seventh embodiment of a connector terminal 900 mounted on a wiring board 902 that is supported in a portion of the terminal housing 10. Three aligned terminals 900 each have wire connecting portions 908 that lie in a plane 909. The terminals 900 also have shoulder portions 904 with first sections 906 that project in planes 907 normally of the planes 909 of the wire connecting portions 908, and wherein the planes 907 of the shoulder portion sections 906 are substantially parallel to the axes A of mounting portions 910 of the terminals. The shoulder portions 904 terminate with second sections 912 that diverge outwardly from the first sections 906 and in-line with one another in a plane 913 that is parallel to the plane 909 of the connecting portions 908. Top and bottom edges of the shoulder portions 904 of the left and the right terminals 900 in FIG. 16, are restrained between the wiring board 902 and the base wall 20 of the terminal housing. The shoulder portion 904 of the center terminal 900 in FIG. 16 is restrained between the wire board 902 and a bottom surface of terminal wire guide posts 914, 916 within which the center terminal 900 in FIG. 16 is captured. Some capacitive coupling between confronting ends 920, 922 of the second shoulder portion sections 912 of the non-adjacent left and right-most terminals 900 in FIG. 16, may be produced for the purpose of reducing or compensating for crosstalk among signal paths carried by the non-adjacent terminals 900.

Figure 17:
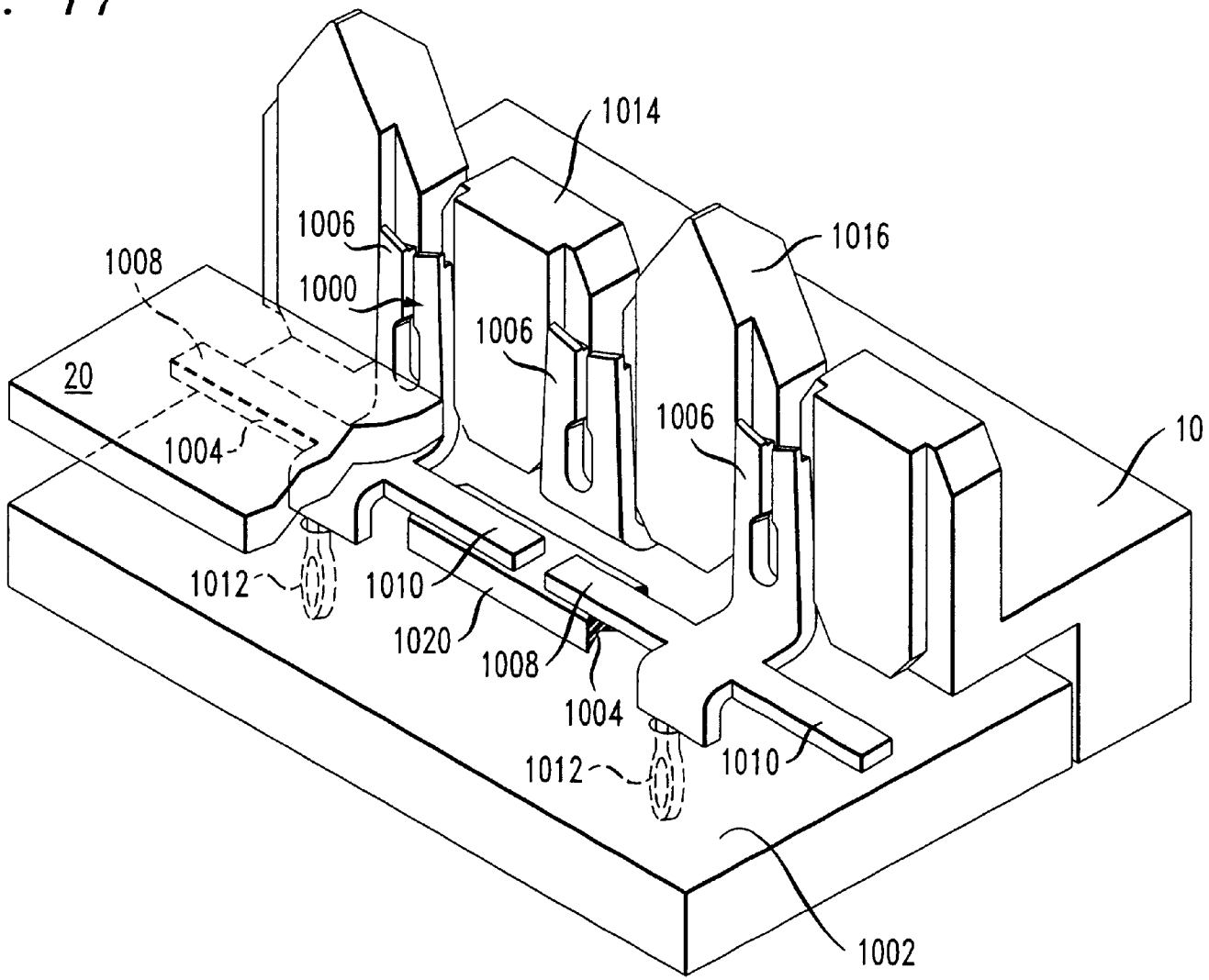
FIG. 17 is a perspective view of an eighth embodiment of an electrical connector terminal mounted on a wiring board within a terminal housing.

FIG. 17 is a view of an eighth embodiment of a connector terminal 1000 mounted on a wiring board 1002 that is supported within a portion of the terminal housing 10. Shoulder portions of three aligned terminals 1000 project normally of wire connecting portions 1006, and are formed as elongated flat finger sections 1008, 1010 that extend in-line from either side of terminal mounting portions 1012. The shoulder portions including the finger portions 1008, 1010 extend in a plane substantially perpendicular to the axes of the mounting portions 1012.

The left and the right terminals in FIG. 17 are mounted so that the finger sections 1008, 1010 will be disposed substantially flush with a bottom surface of the base wall 20 of the terminal housing 10, thus restraining movement of the two terminals 1000 upwardly. The center terminal 1000 in FIG. 17 is mounted so that the flat finger sections of its shoulder portion are disposed substantially flush with a bottom surface of terminal wire guide posts 1014, 1016 within which the center terminal is captured. Upward movement of the center terminal is thus restrained by the bottom surface of the guide posts acting against the finger sections of the terminal. An insulative strip or step 1020 may be disposed on the wiring board directly beneath and in contact with the terminal shoulder portions to restrain downward movement of the shoulder portions and their associated terminals. Some capacitive coupling between confronting finger section 1010 of the left-most terminal 1000 in FIG. 17, and the finger section 1008 of the right-most, non-adjacent terminal, may be produced to reduce or compensate for crosstalk among signal paths carried by the non-adjacent terminals 1000.

While the foregoing description represents preferred embodiments of the invention, it will be obvious to those skilled in the art that various changes and modifications may be made, without departing from the spirit and scope of the invention pointed out by the following claims.

We claim:

1. An electrical connector terminal comprising:

an elongated generally planar wire connecting portion formed to connect electrically with an outside wire lead, said connecting portion defining a first plane;

a shoulder portion having a planar first section that extends from a first side of the connecting portion, wherein said first section defines a second plane that is normal to the first plane of the connecting portion so that the terminal will be held stable when the terminal is mounted on a wiring board and the first section of the shoulder portion is restrained by being positioned between said wiring board and an outside part located out of the first plane of the wire connecting portion; and an elongated wire board mounting portion having an axis and formed to fit axially in a terminal opening in the wiring board, wherein the mounting portion is joined to a free end of the first section of the shoulder portion remote from the wire connecting portion, and the second plane defined by said first section includes the the axis of said mounting portion.

2. A connector terminal according to claim 1, wherein said wire connecting portion, said shoulder portion and said mounting portion are formed integrally from a sheet of metallic material.

3. A connector terminal according to claim 1, wherein said wire connecting portion has an insulation displacement connector (IDC) configuration.

4. A connector terminal according to claim 1, wherein said mounting portion has two opposed curvilinear sections forming an elongated open needle-eye configuration about the axis of the mounting portion.

5. An electrical connector terminal block, comprising:

a housing;

a wiring board supported in the housing;

a base wall supported in the housing in the vicinity of the wiring board;

a first connector terminal and a second connector terminal mounted on the wiring board, wherein each connector terminal includes:

an elongated generally planar wire connecting portion formed to connect electrically with an outside wire lead, said connecting portion defining a first plane;

a shoulder portion having a planar first section that extends from a first side of the connecting portion, wherein the first section defines a second plane that is normal to the first plane of the connecting portion and the first section of the shoulder portion is restrained by being positioned between said wiring board and said base wail at a position out of the first plane of the wire connecting portion so that the connector terminal is held stable relative to said wiring board; and an elongated wiring board mounting portion having an axis and formed to fit axially in a terminal opening in the wiring board, wherein the mounting portion is joined to a free end of the first section of the shoulder portion remote from the wire connecting portion, and the second plane defined by said first section includes the axis of the mounting portion.

6. An electrical connector terminal block according to claim 5, wherein the wire connecting portion, the shoulder portion and the mounting portion of the first and the second connector terminals are formed integrally from a sheet of metallic material.

7. A connector terminal block according to claim 5, wherein the wire connecting portion of each connector terminal has an insulation displacement connector (IDC) configuration.

8. A connector terminal block according to claim 5, wherein the mounting portion of each connector terminal has two opposed curvilinear sections forming an elongated open needle-eye configuration about the axis of the mounting portion.

9. An electrical connector terminal block according to claim 5, including terminal wire guide posts formed on said housing, and the guide posts have channels for receiving the wire connecting portions of the first and the second connector terminals.

10. An electrical connector terminal, comprising:

an elongated generally planar wire connecting portion formed to connect electrically with an outside wire lead, said connecting portion defining a first plane;

a shoulder portion having a planar first section that extends from a first side of the wire connecting portion, and a planar second section tat extends from a second side of the wire connecting portion opposite said first side, wherein the first and the second sections define corresponding second and third planes that are normal to the first plane of the connecting portion so that the terminal will be held stable when mounted on a wiring board and the first and the second sections of the shoulder portion are restrained by being positioned between said wiring board and an outside part located out of the first plane of the wire connecting portion; and an elongated wiring board mounting portion having an axis and formed to fit axially in a terminal opening in the wiring board, wherein the mounting portion is joined to a free end of the first section of the shoulder portion remote from the wire connecting portion, and the second plane defined by the first section includes the axis of said mounting portion.

11. A connector terminal according to claim 10, wherein said wire connecting portion, said shoulder portion and said mounting portion are formed integrally from a sheet of metallic material.

12. A connector terminal according to claim 10, wherein said wire connecting portion has an insulation displacement connector (IDC) configuration.

13. A connector terminal according to claim 10, wherein said mounting portion has two opposed curvilinear sections forming an elongated open needle-eye configuration about the axis of the mounting portion.

14. An electrical connector terminal arrangement, comprising:

a wiring board; and at least a first connector terminal and a second connector terminal mounted on the wiring board, wherein each connector terminal includes:

an elongated generally planar wire connecting portion formed to connect electrically with an outside wire lead, said connecting portion defining a first plane;

a shoulder portion having a planar first section that extends from a first side of the wire connecting portion, and a planar second section that extends front a second side of the wire connecting portion opposite said first side, wherein the first and the second sections define corresponding second and third planes that are normal to the first plane of the connecting portion so that the terminal is held stable relative to the wiring board when the first and the second sections of the shoulder portion are restrained by being positioned between said wiring board and an outside part at positions out of the first plane of the wire connecting portion; and an elongated wiring board mounting portion having an axis and formed to fit axially in a terminal opening in the wiring board, wherein the mounting portion is joined to a free end of the first section of the shoulder portion remote from the wire connecting portion, and the second plane defined by the first section includes the axis of said mounting portion; and the first and the second connector terminals are mounted on the wiring board so that the second section of the shoulder portion of one of the terminals and the second section of the shoulder portion of the other one of the terminals are parallel and adjacent to one another, and a desired amount of capacitive coupling is produced between the adjacent second sections.

15. A connector terminal arrangement according to claim 14, wherein the wire connecting portion, the shoulder portion and the mounting portion of each of the connector terminals are formed integrally from a sheet of metallic material.

16. A connector terminal arrangement according to claim 14, wherein the wire connecting portion of each terminal has an insulation displacement connector (IDC) configuration.

17. A connector terminal arrangement according to claim 14, wherein the mounting portion of each terminal has two opposed curvilinear sections forming an elongated open needle-eye configuration about the axis of the mounting portion of the terminal.

18. An electrical connector terminal block, comprising;

a housing;

wiring board supported in the housing;

a base wall supported in the housing in the vicinity of the wiring board;

a first connector terminal and a second connector terminal mounted on the wiring board, wherein each connector terminal includes:

an elongated generally planar wire connecting portion formed to connect electrically with an outside wire lead, said connecting portion defining a first plane;

a shoulder portion having a planar first section that extends from a first side of the wire connecting portion, and a planar second section that extends from a second side of the wire connecting portion opposite said first side, wherein the first and the second sections define corresponding second and third planes that are normal to the first plane of the connecting portion and the first and the second sections are restrained by being positioned between said wiring board; and and said base wall at positions out of the first plane of the wire connecting portion so that the connector terminal is held stable relative to the wire board; and an elongated wiring board mounting portion having an axis and formed to lit axially in a terminal opening in the wiring board, wherein the mounting portion is joined to a free end of the first section of the shoulder portion remote from the wire connecting portion, and the second plane defined by the first section includes the axis of said mounting portion.

19. An electrical connector terminal block according to claim 18, wherein the wire connecting portion, the shoulder portion and the mounting portion of the first and the second connector terminals are formed integrally from a sheet of metallic material.

20. A connector terminal block according to claim 18, wherein the wire connecting portion of each connector terminal has an insulation displacement connector (IDC) configuration.

21. A connector terminal block according to claim 18, wherein the mounting portion of each connector terminal has two opposed curvilinear sections forming an elongated open needle-eye configuration about the axis of the mounting portion.

22. An electrical connector terminal block according to claim 18, including terminal wire guide posts formed on said housing, and the guide posts have channels for receiving the wire connecting portions of the first and the second connector terminals.

* * * * *